United States Patent [19]

Sakakibara et al.

[11] Patent Number: 4,673,416

[45] Date of Patent: Jun. 16, 1987

[54] AIR CLEANING APPARATUS

[75] Inventors: Nobuyoshi Sakakibara, Hekinan; Tadashi Hattori, Okazaki; Kazuhiko Miura, Aichi; Hiroki Noguchi, Nishio; Akira Fukami; Teiichi Nabeta, both of Okazaki, all of Japan

[73] Assignees: Nippondenso Co., LTd.; Nippon Soken, Inc., both of Nishio, Japan

[21] Appl. No.: 874,820

[22] Filed: Jun. 12, 1986

Related U.S. Application Data

[63] Continuation of Ser. No. 678,159, Dec. 4, 1984, abandoned.

[30] Foreign Application Priority Data

Dec. 5, 1983 [JP] Japan ..... 58-230393

[51] Int. Cl.[4] ..... B03C 3/12

[52] U.S. Cl. ..... 55/137; 55/138; 55/152; 55/139; 55/146; 55/155

[58] Field of Search ..... 55/137, 138, 139, 146, 55/152, 155, 139

[56] References Cited

U.S. PATENT DOCUMENTS

| | | | |
|---|---|---|---|
| 2,978,066 | 4/1961 | Nodolf | 55/155 |
| 3,650,092 | 3/1972 | Gourdine et al. | 55/137 |
| 4,264,343 | 4/1981 | Natarjan et al. | 55/138 |

FOREIGN PATENT DOCUMENTS

| | | | |
|---|---|---|---|
| 495155 | 8/1978 | Australia | 55/137 |
| 2719035 | 11/1977 | Fed. Rep. of Germany | 55/124 |
| 1022859 | 3/1966 | United Kingdom | 55/138 |
| 2112582 | 7/1983 | United Kingdom | 422/121 |

*Primary Examiner*—Bernard Nozick

*Attorney, Agent, or Firm*—Cushman, Darby & Cushman

[57] ABSTRACT

An air cleaning apparatus having an electrical dust collecting section has discharge electrodes, electrical field forming electrodes arranged parallel to the flow of charged particles, and dust collecting electrodes each of which is arranged between corresponding two adjacent electrical field forming electrodes to be parallel thereto. One high voltage power source is arranged to generate a potential difference between the discharge electrodes and the dust collecting electrodes. Another high voltage power source is arranged to generate a potential difference between the electrical field forming electrodes and the dust collecting electrodes. Negative electrodes consisting of either the electrical field forming electrodes or the dust collecting electrodes are covered by insulator members.

4 Claims, 8 Drawing Figures

AIR CLEANING APPARATUS

This is a continuation of application Ser. No. 678,159, filed Dec. 4, 1984, which was abandoned upon the filing hereof.

BACKGROUND OF THE INVENTION

1. Field of the Invention

The present invention relates to an air cleaning apparatus having an electrical dust collecting section. In this specification, the term "dust" is used to refer mainly to particulate pollutants such as cigarette smoke.

2. Description of the Related Art

A conventional electrical dust collecting section comprises an electrical discharge electrode for ionizing molecules in air, and electrical field forming and dust collecting electrodes for electrostatically attaching and collecting dust particles charged by ions. The dust collecting electrodes have a large dust collecting area to improve dust collection efficiency. This large dust collecting area, however, prevents the forming of a compact, lightweight air cleaning apparatus. To decrease the lengths of the electrical field forming and dust collecting electrodes along the direction of the air flow without lowering the dust collection efficiency, the strength of an electrical field formed between the electrical field forming electrodes and the dust collecting electrodes must be increased. In this case, however, there is a tendency for a spark discharge to occur, which can lead to various problems arising.

SUMMARY OF THE INVENTION

It is an object of the present invention to provide an improved air cleaning apparatus incorporating an electrical dust collecting unit which is compact and light in weight, which has a high dust collection efficiency, and which is substantially free from spark discharge.

According to the fundamental aspect of the present invention, there is provided an air cleaning apparatus including a housing having an air suction opening and an air exhaust opening; an electrical discharge electrode arranged in the suction side of the housing; a plurality of electrical field forming electrodes arranged opposite the electrical discharge electrode, maintaining a discharge gap between the electrical discharge electrode, and arranged in parallel with the flow of charged particles; and a plurality of dust collecting electrodes between the electrical field forming electrodes arranged in parallel with the electric field forming electrodes. The air cleaning apparatus also includes a first high voltage source for establishing a potential difference between the electrical discharge electrode and the dust collecting electrodes, and a second high voltage source for establishing a potential difference between the electrical field forming electrodes and the dust collecting electrodes. In the air cleaning apparatus, the negative electrodes consisting of either the electrical field forming electrodes or the dust collecting electrodes are covered by an insulator member.

DESCRIPTION OF THE PREFERRED EMBODIMENTS

Figure 1:
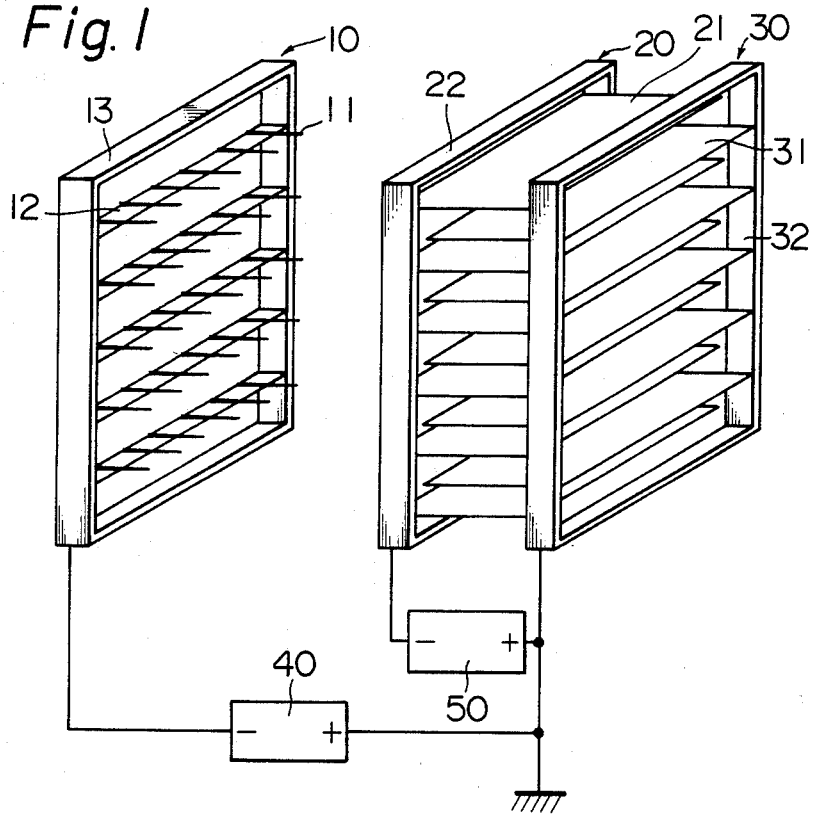
FIG. 1 is a schematic view showing an air cleaning apparatus according to an embodiment of the present invention.
Figure 2:
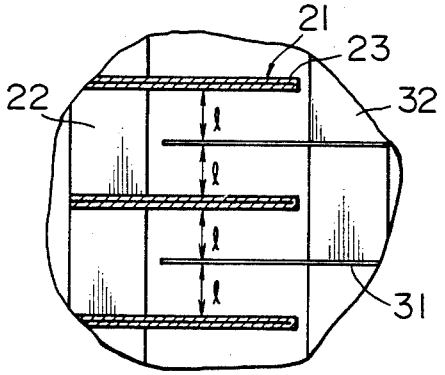
FIG. 2 is a sectional view showing the main part of the apparatus shown in FIG. 1.

FIGS. 1 and 2 show the basic arrangement of an electrical dust collecting section according to an embodiment of the present invention.

Referring to FIG. 1, the proximal portions of needle discharge electrodes 11 for generating corona discharge are bonded by welding or the like to the corresponding surfaces of metal plates 12 in such a manner that the discharge electrodes 11 extend perpendicular to the long sides of the metal plates 12. The lengths of these discharge electrodes 11 from their distal ends to the corresponding metal plates 12 are the same, and the discharge electrodes 11 are fixed at equal horizontal intervals. The metal plates 12 having the same construction and the discharge electrodes 11 bonded thereon are parallel to each other and are conductively bonded by welding or the like to a metal frame 13, in such a manner that the discharge electrodes 11 are aligned at equal vertical intervals. Thus, the discharge electrodes 11 are uniformly aligned at equal horizontal and vertical intervals within the metal frame 13. The discharge electrodes 11, the metal plates 12, and the metal frame 13 constitute a discharge section 10.

An electrical field forming section 20 and a dust collecting section 30 are located opposite the discharge section 10. In the electrical field forming section 20, a plurality of plate-like electrical field forming electrodes 21 covered with insulator members 23 are aligned parallel to each other at equal intervals and are conductively bonded to an electrode frame 22. In the dust collecting section 30, a plurality of dust collecting electrodes 31, each made of a metal, are arranged parallel to each other at equal intervals. Each dust collecting electrode 31 is positioned at an intermediate position between two adjacent electrical field forming electrodes 21 and is conductively bonded to an electrode frame 32.

As shown in FIG. 2, the electrical field forming and dust collecting electrodes 21 and 31 are alternately arranged at equal intervals l.

A negative terminal of a first DC high voltage power source 40 is connected to the discharge section 10, and a positive terminal thereof is connected to the electrode frame 32 of the dust collecting section 30 and is grounded to thus create an ion wind.

A negative terminal of a second DC high voltage power source 50 is connected to the electrode frame 22 of the electrical field forming section 20, and a positive terminal thereof is connected to the electrode frame 32 of the dust collecting section 30 and is grounded.

The physical phenomenon occurring when a high voltage is applied between the electrical field forming electrodes 21 and the dust collecting electrodes 31 will be described.

Figure 3:
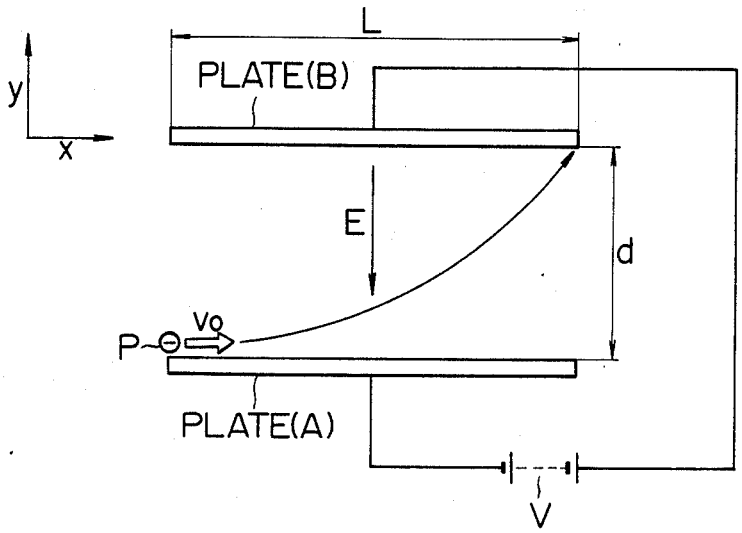
FIG. 3 is a representation explaining the principle of charged particle behavior in an electrical field region formed between plate electrodes.

FIG. 3 shows the movement of the charged particles in an electrostatic field. Assuming that a charged particle P having a mass M (kg) and a charge g (Coulomb) is moved at a velocity $V_0$ (m/s) along the x direction in an electrical field E (V/m) acting along the y direction. The charged particle receives a force $F = q \cdot E$ (N) along the y direction, and an acceleration $\alpha = F/M = q \cdot E/M$ ($m/s^2$) acts on the charged particle P. Assuming that a length of the parallel plates for forming an electrical field, a distance between two adjacent plates, and a voltage applied thereto are defined as L, d and V, respectively, and also assuming that the charged particle P is located in the vicinity of the electrode plate PLATE(A) having the same polarity as the charged particle P. Then the length L required for attaching the charged particle P to the opposing electrode plate PLATE(B) is given as follows:

$$L = V_0 \cdot (2Md^2/q \cdot V)^{\frac{1}{2}}$$

In order to decrease the length L, the electrode distance d must be decreased and the voltage V must be increased. However, when the distance d and the voltage V are excessively decreased and increased, respectively, the intensity of the resultant electrical field is excessively increased. Under this condition, the entire path between the opposing electrodes is damaged, resulting in spark discharge therebetween. The following principle of spark discharge can be applied when a spark discharge occurs between two parallel metal plates upon application of a high voltage.

Light quanta or positive ions present in the air are bombarded against the plate electrode, which thus receives energy exceeding a work function. When electrons are emitted from the negatively charged electrode plate, the electrons are accelerated by the electrical field. The accelerated electrons are then bombarded against molecules in the air to ionize the molecules. This behavior is known as the $\alpha$ effect. The number of electrons is increased by this $\alpha$ effect, thereby causing an electron avalanche phenomenon. When the energy density of the electron avalanche exceeds that of the electrostatic field, the electron avalanche can amplify itself without assistance from the electrostatic field, thus generating spark discharge. When the negatively charged plate electrode is covered with an insulator member, electrons will not be emitted from the surface of the insulator member. The electrons to be accelerated by the electrical field are inherently electrons present in the air. For this reason, a substantial electron avalanche will not occur. Therefore, the strength of the electrostatic field can be increased without causing spark discharge. This phenomenon was observed by the present inventor.

Figure 4:
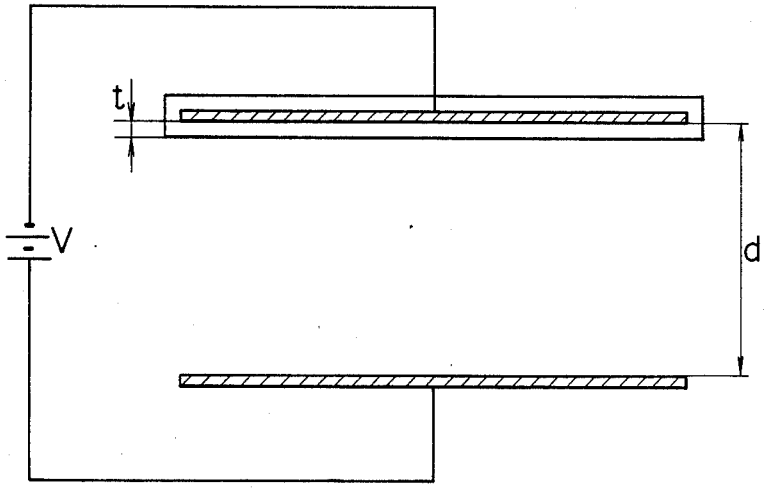
FIG. 4 is a representation explaining the principle of an electrostatic field when one of the electrode plates in FIG. 3 is covered by an insulator member.

FIG. 4 shows an electrode construction wherein one of two opposing electrodes is coated by an insulator member. If a thickness of an insulator member, a relative dielectric constant, a distance between the opposing electrodes, and a voltage to be applied therebetween are given as t, $\epsilon$, d and V, respectively, a potential $V_1$ at the surface of the insulator member is derived as follows:

$$V_\omega = \{(d-t) \cdot V\} / \{\epsilon(d-t)+t\}$$

In order to obtain the distance d of about 5 mm, the relative dielectric constant $\epsilon$ of about 10, and a ratio $(V-V_1)/V$ of about 1%, the thickness t of the insulator member becomes about 0.5 mm. Even if the insulator member 23 covers the entire surface of the electrode, and the thickness of the insulating film on each major surface of the electrode is not more than 0.5 mm, the difference between the surface potential of the insulator member and the applied voltage corresponds to a ratio of 1%. Therefore, the insulator member 23 will not substantially influence the dust collection efficiency.

The insulator member 23 and a method of covering the surface of the electrode with the insulator member 23 to obtain the ratio $(V-V_1)/V$ of about 1% are such that a thickness of the insulator member 23 is not more than about 0.5 mm and the insulator member 23 is free from pinholes. For example, if glass is used as an insulator, a low-melting glass powder or the like is mixed with a proper solvent, and the resultant mixture is applied to the surfaces of the electrode. The electrode covered with the mixture is then sintered to obtain the insulator member 23. Furthermore, if a ceramic material is used as the insulator member 23, a metal paste made of platinum, tungsten or the like is printed on an insulating substrate to obtain a laminate. The resultant laminate is sintered to prepare the insulator member 23. In addition, a metal paste may be printed and baked, and the resultant metal paste may be bonded by an adhesive to the sintered sheet. Anodic oxidation may also be utilized wherein a metal oxide is formed on a metal electrode made of Al, Ta, Ni, Nb, Ti or the like. The metal oxide is used as the insulator member 23. Still another method can be used wherein a material such as varnish, wax or resin is applied to the surfaces of the electrode and is dried. An insulating film serving as the insulator member 23 may be formed by a vacuum technique such as deposition or sputtering.

Figure 5:
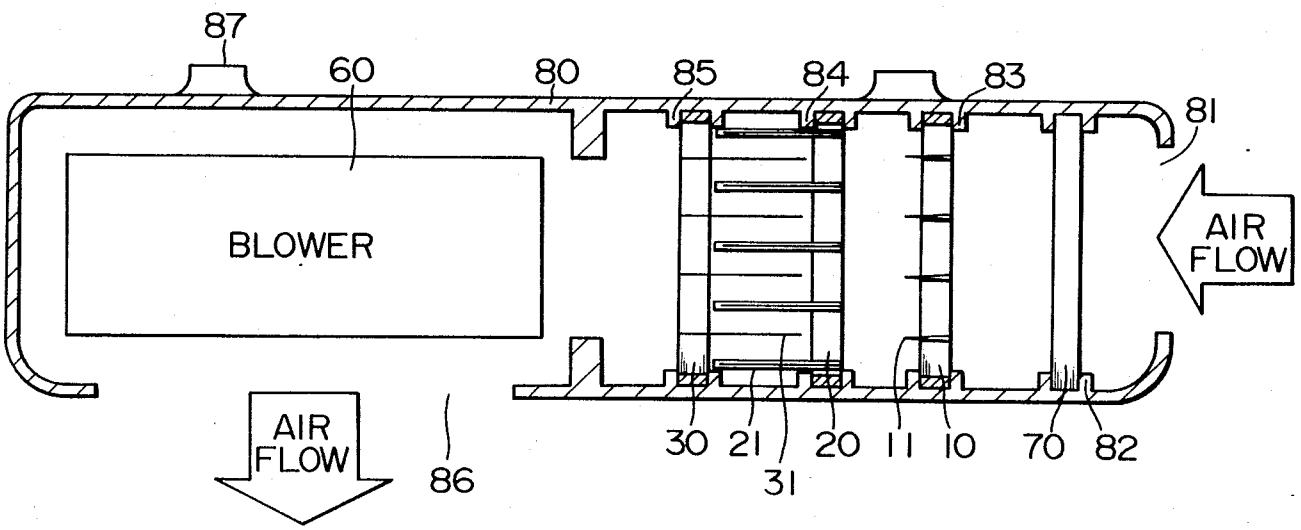
FIG. 5 is a sectional view schematically showing a ceiling mount type air cleaning apparatus according to the present invention.

FIG. 5 is a schematic sectional view of a ceiling mount type air cleaning apparatus which incorporates the discharge electrodes 11, the electrical field forming electrodes 21 covered by insulator members, and the dust collecting electrodes 31. Referring to FIG. 5, reference numeral 60 denotes a blower having a fan for exhausting air from a room and a motor for driving the fan. Reference numeral 70 denotes a filter for eliminating large particles of dust from the air; 80, an air cleaning apparatus housing; 81, an air suction opening formed at the side surface of the housing 80; 82, a holder integrally formed with the housing 80 to fix the filter 70; 83, a holder integrally formed with the housing 80 to fix the discharge section 10; 84, a holder integrally formed with the housing 80 to fix the electrical field forming section 20; 85, a holder integrally formed with the housing 80 to detachably mount the dust collecting section 30; and 86, an air exhaust opening formed in the lower surface of the housing 80.

Referring to FIG. 5, the negative terminal of the first high voltage power source 40 is connected to the discharge electrodes 11 through high-voltage lead wires (not shown). Similarly, the positive terminal of the high voltage power source is connected to the dust collecting electrodes 31 through lead wires. A voltage of several kilovolts to several tens of kilovolts is applied between the discharge and dust collecting electrodes 11 and 31. Corona discharge occurring in an electrical field is concentrated in the vicinity of the needle-like distal ends of the discharge electrodes 11. The positive and negative ions are generated by the corona discharge. In this case, the positive ions having a polarity opposite to that of the discharge electrodes 11 are attracted by the discharge electrodes 11. Only the negative ions are attracted toward the dust collecting electrodes 31. During the movement of the negative ions toward the dust collecting electrodes 31, the negative ions are bombarded against the dust particles in the air. Therefore, the particles are negatively charged.

In FIG. 5, the negative terminal of the second high voltage power source 50 is connected to the electrical field forming electrodes 21 through lead wires (not shown). Similarly, the positive terminal of the second high voltage power source 50 is connected to the dust collecting electrodes 31 through lead wires. A voltage of several kilovolts to several tens of kilovolts is applied between the electrical field forming and dust collecting electrodes 21 and 31 to form a DC electrical field in a direction perpendicular to the flow of the charged particles. In this case, the insulator coating is formed on the surfaces of the electrical field forming electrodes 21 to prevent the electrons from being emitted from the surfaces of the electrical field forming electrodes 21, thereby increasing the intensity of the electrical field without causing the spark charge. Also, the insulator coating has an effect of easing the concentration of the electric field at the edge of the electrode plate. The charged particles receive the strong DC electrical field and are collected on the dust collecting electrodes 31. Since the dust particles are collected on the dust collecting electrodes 31, the dust collecting electrodes must be periodically cleaned or replaced. Therefore, the dust collecting electrodes 31 must be detachably mounted.

Figure 6:
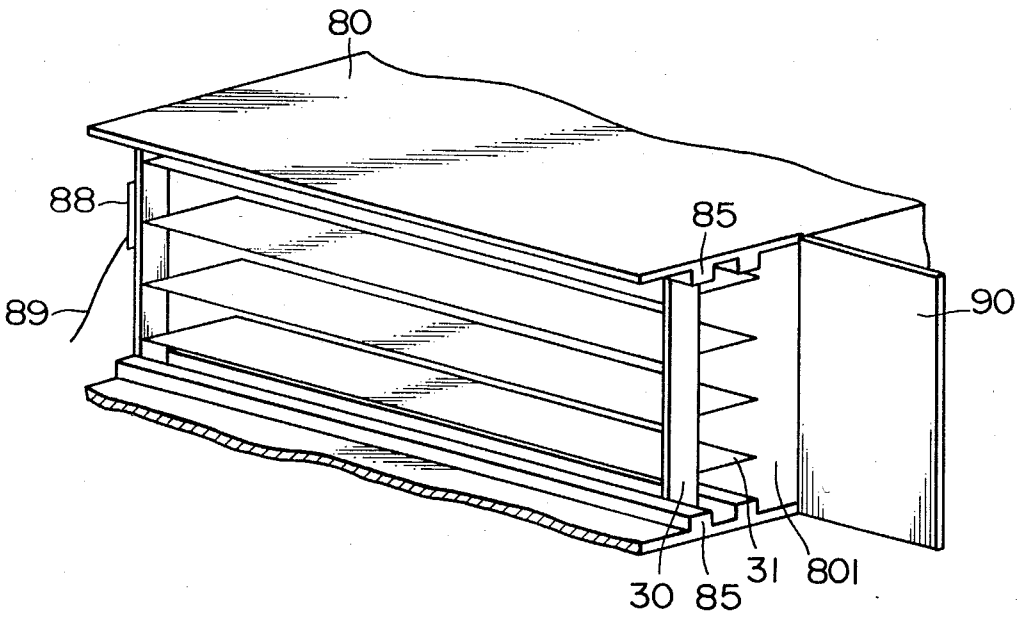
FIG. 6 is a partial perspective view showing the mounting of the dust collecting electrodes shown in FIG. 5.

FIG. 6 is a perspective view showing part of the dust collecting electrodes and the housing 80. Referring to FIG. 6, reference numerals 85 denote guides/holders mounted on the housing to guide and hold the dust collecting electrodes 31; and 90, a cover mounted on the side surface of the housing to detachably mount the electrodes therethrough. More particularly, the cover 90 is mounted on the housing and is pivotal about a plastic hinge (not shown) to open or close an opening 801 formed on the side surface of the housing. Reference numeral 88 denotes a terminal block for the dust collecting electrodes. The terminal block 88 is mounted on the side surface of the housing. Reference numeral 89 denotes a lead wire for connecting the terminal block 88 to the positive terminal of the high voltage source and for grounding the positive terminal.

The dust collecting plate electrodes 31 extend as illustrated in FIG. 6. However, the electrodes 31 are moved along their longitudinal direction to be parallel to each other, so that these electrodes 31 can be easily removed through the opening 801 without interference from the electrical field forming electrodes 21.

Figure 7:
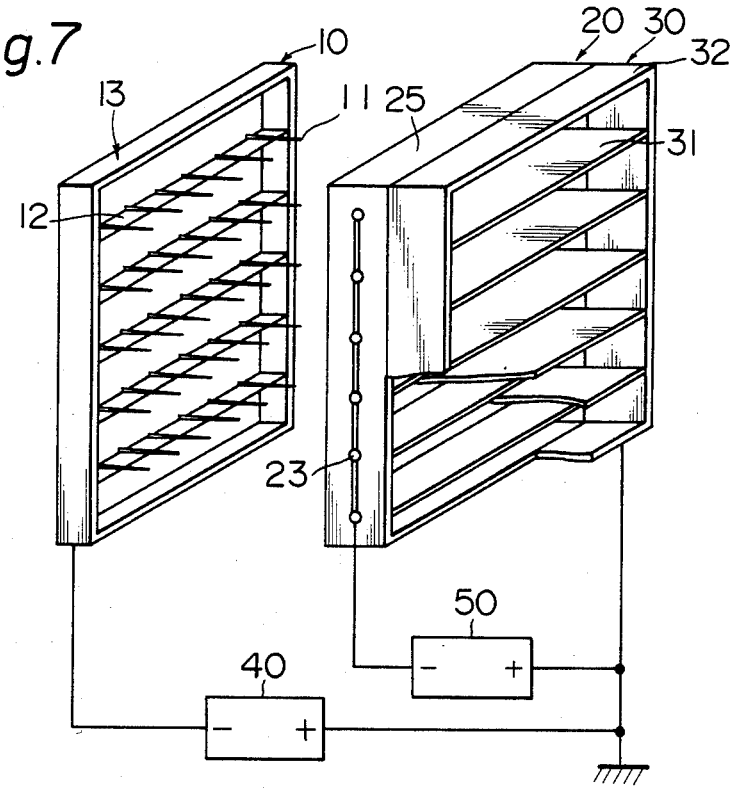
FIG. 7 is a schematic view showing an air cleaning apparatus according to another embodiment of the present invention.
Figure 8:
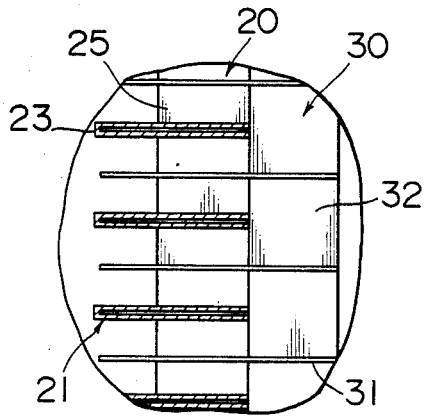
FIG. 8 is a sectional view showing the main part of the apparatus shown in FIG. 7.

FIGS. 7 and 8 show another embodiment of the present invention. A frame 25 of an electrical field forming section 20 is arranged to be in contact with a frame 32 of a dust collecting section 30. The frame 25 of the electrical field forming section 20 is made of an insulating material. Terminals 23 are formed on the side surface of the frame 25 to supply power to the electrical field forming electrodes 21, respectively. In this case, as shown in FIG. 8, the distal ends of the electrical field forming electrodes 21 and the distal ends of the dust collecting electrodes 31 extend toward the upstream space of the frame 25 to constitute a dust collecting section. Other arrangements in this embodiment are substantially the same as those of the apparatus shown in FIG. 1. As described above, in the apparatus shown in FIG. 7, the frame 25 of the electrical field forming section 20 and the frame 31 of the dust collecting section 30 are in contact with each other, so that an installation space of the apparatus shown in FIG. 7 becomes smaller than that in FIG. 1.

The blower 60 having a fan as an air supplying means of the air cleaning apparatus is used in the embodiment shown in FIG. 5. However, instead of this fan, an ionized air flow may be generated by corona discharge to realize an air cleaning apparatus of the ionic wind type.

In the embodiments described above, the negative voltage is applied to the discharge electrodes 11. However, the voltages may be applied to positively charge the discharge electrodes 11 and the electrical field forming electrodes 21 and to negatively charge the dust collecting electrodes 31. In this case, the insulator member is formed on the dust collecting electrode 31.

In the embodiments previously mentioned, two power sources (i.e., the first and second high voltage power sources 40 and 50) are used. However, the voltages applied to the discharge electrodes 11 and the electrical field forming electrodes 21 have the same polarity. Therefore, a single power source may be used to apply the same voltage to the discharge and electrical field forming electrodes 11 and 21.

We claim:

1. An ion wind air cleaning apparatus comprising:

a housing having an air suction opening and an air exhaust opening to create a wind therethrough;

a plurality of electrical discharge electrodes arranged in said housing adjacent said suction opening;

a plurality of electrical field forming electrodes arranged in said housing downwind of and spaced from said electrical discharge electrodes to form a discharge gap therebetween, said electrical field forming electrodes being arranged in parallel with the flow of charged particles;

a plurality of dust collecting electrodes arranged between and in parallel with said electrical field forming electrodes;

high voltage means for establishing a potential difference between said electrical discharge electrodes and said dust collecting electrodes to create an ion wind and for establishing a potential difference between said electrical field forming electrodes and said dust collecting electrodes;

a terminal of one polarity of said high voltage means being connected with said electrical discharge electrodes and said field forming electrodes;

the terminal of the other polarity of said high voltage means being connected with said dust collecting electrodes, either of said field forming electrodes or said dust collecting electrodes being negatively charged; and an insulator member covering the entire surface either of said dust collecting electrodes and said field forming electrodes of which the polarity connection is negative.

2. The apparatus defined in claim 1 wherein the terminal of one polarity is negative and the insulator member covers the electrical field forming electrodes.

3. The apparatus defined in claim 1 wherein the terminal of one polarity is positive and the insulator member covers the dust collecting electrodes.

4. An apparatus according to claim 1, wherein said insulator member is provided to satisfy the relationship:

$$\frac{V - V_1}{V} \times 100 \leqq 1$$

where V is the voltage applied by the high voltage means to establish the potential difference between the field forming electrodes and the dust collecting electrodes and $V_1$ is the potential of the surface of said insulator member.

* * * * *

UNITED STATES PATENT AND TRADEMARK OFFICE

CERTIFICATE OF CORRECTION

PATENT NO. : 4,673,416

DATED : June 16, 1987

INVENTOR(S) : Nobuyoshi SAKAKIBARA, et al.

It is certified that error appears in the above-identified patent and that said Letters Patent is hereby corrected as shown below:

[73] Assignees: Nippondenso Co., Ltd., of Kariya, Japan;
Nippon Soken, Inc., of Nishio, Japan

Signed and Sealed this

Fifth Day of January, 1988

*Attest:*

DONALD J. QUIGG

*Attesting Officer*

*Commissioner of Patents and Trademarks*